US012690707B2

(12) United States Patent
Gonzalez

(10) Patent No.: US 12,690,707 B2
(45) Date of Patent: Jul. 28, 2026

(54) ELASTIC SAFETY DRINK COVER

(71) Applicant: Jhoann Gonzalez, Miami, FL (US)

(72) Inventor: Jhoann Gonzalez, Miami, FL (US)

( * ) Notice: Subject to any disclaimer, the term of this patent is extended or adjusted under 35 U.S.C. 154(b) by 0 days.

(21) Appl. No.: 18/976,783

(22) Filed: Dec. 11, 2024

(65) Prior Publication Data

US 2025/0194832 A1 Jun. 19, 2025

Related U.S. Application Data

(60) Provisional application No. 63/610,687, filed on Dec. 15, 2023.

(51) Int. Cl.
*A47G 19/22* (2006.01)

(52) U.S. Cl.
CPC .... *A47G 19/2272* (2013.01); *A47G 2400/123* (2013.01)

(58) Field of Classification Search
CPC ..... A47G 19/2272; A47G 2400/123; A47G 19/2211; A47G 19/2216; A47G 19/2222; B65D 41/22; B65D 2517/0041; B65D 2517/0043; B65D 2543/0037; B65D 55/06

See application file for complete search history.

(56) References Cited

U.S. PATENT DOCUMENTS

| | | | | |
|---|---|---|---|---|
| 10,220,984 | B1 * | 3/2019 | Vigoureux | B65D 41/22 |
| 2005/0056651 | A1 * | 3/2005 | Gibney | B65D 81/2038 220/622 |
| 2008/0190945 | A1 * | 8/2008 | Milnark | B65D 43/0222 220/709 |
| 2014/0339119 | A1 * | 11/2014 | Smit | A47G 19/2227 53/488 |
| 2015/0274380 | A1 * | 10/2015 | Lu | B65D 47/141 220/592.17 |
| 2016/0051069 | A1 * | 2/2016 | Turner | A61J 11/02 222/567 |
| 2018/0199741 | A1 * | 7/2018 | Taylor | A47G 21/182 |
| 2019/0142191 | A1 * | 5/2019 | Althaher | B65D 43/0202 220/713 |

* cited by examiner

*Primary Examiner* — Shawn M Braden
(74) *Attorney, Agent, or Firm* — Larisa Migachyov

(57) ABSTRACT

A safety cover for a drink to prevent tampering, comprising a long cylindrical body that stretches over a drink glass in a way that is difficult to remove, high-friction features to make the cylindrical body even harder to remove from the glass, and a small opening for drinking or straw insertion that is difficult to use for unauthorized tampering of the drink.

18 Claims, 3 Drawing Sheets

ELASTIC SAFETY DRINK COVER

CROSS-REFERENCE TO RELATED APPLICATIONS

The present application takes priority from Provisional App. No. 63/610,687, filed Dec. 15, 2023, which is hereby incorporated by reference.

BACKGROUND

Field of the Invention

The invention relates generally to beverage containers and specifically to anti-tampering safety covers for a beverage glass or cup.

Background of the Invention

Many people, both male and female, enjoy going out to bars to drink. Unfortunately, bars are often a dangerous place for women; a woman who leaves her drink unattended even for a second may have a date-rape drug or some other unwanted substance slipped into her drink by an unscrupulous attacker. In most bar situations, it takes less than a second for someone to slip a date-rape drug into someone's drink; maintaining the kind of vigilance that would prevent such an attack is so onerous that it would preclude any sort of enjoyment. Also, even a mildly tipsy person would find it very difficult to maintain perfect vigilance over their drink-alcohol inhibits the neurological functions that are needed to do this.

A need exists for a method of protecting a drink that makes it difficult to slip a substance into the drink while still making it easy for the owner to drink it.

SUMMARY OF THE INVENTION

An object of the present invention is to provide a safety cover that securely covers a beverage glass and that is difficult to remove.

Another object of the present invention is to provide a safety cover that protects a drink from unauthorized tampering.

Another object of the present invention is to allow women and other vulnerable persons to drink safely in a bar or other public drinking situation.

Another object of the present invention is to provide a safety cover that is unobtrusive and does not detract from the appearance of the drinking glass.

The safety cover of the present invention comprises an approximately flat circular top and a cylindrical body projecting from the flat circular top, both made of a thin elastic material. The height of the cylindrical body is at least 75% of the height of the drinking glass. The radius of the top and the cylindrical body is a little smaller than the radius of a drinking glass. At least two pull tabs are placed on the distal edge of the cylindrical body to assist in installation or removal. A small sip opening is located close to an edge of the flat circular top. The safety cover is configured in such a way as to make it difficult to remove once it is installed on a drinking glass In an embodiment, the safety cover is made of silicone rubber. The thickness of the silicone rubber could be 1 mm for the top and 0.8 mm for the cylindrical body.

In an embodiment, the top cover could have a diameter of 2.5 inches. The cylindrical body could have a height of 2.5 inches or more, and a diameter that is less than a diameter of a drinking glass on which it is installed.

In an embodiment, the inner surface of the cylindrical body comprises a high-friction surface that adheres to the drinking glass. The high-friction surface could be a cylindrical ring around the circumference of the cylindrical body, with recessed rings above and below the cylindrical ring, and a second cylindrical ring below the lower recessed ring at the edge of the cylindrical body. The cylindrical ring could have a height of approximately 5 mm. The thickness of the material at the recessed rings could be 0.5 mm, with the thickness of the material being 0.8 mm at the cylindrical ring and 1 mm at the second cylindrical ring.

In an embodiment, the safety cover is translucent.

In an embodiment, the sip opening has a radius of approximately 5 mm. In another embodiment, the sip opening has a width of approximately 5 mm and a length of approximately 1 cm. The sip opening may also comprise a lip around the perimeter, and further comprise a sip plug that can close the sip opening entirely. The sip plug may comprise a ring that interlocks with the opening and a plug attached to the ring that plugs into the opening and occludes it completely.

In an embodiment, the safety cover has at least two pull tabs placed on a distal edge of the cylindrical body to assist in its installation or removal.

The present invention also discloses a method for protecting a drink from unauthorized tampering. The method comprises providing a drinking glass containing a beverage, and providing a safety cover comprising an elastic material. The safety cover comprises a top cover and a cylindrical body; the cylindrical body has a diameter that is slightly less than the diameter of the drinking glass and a height that is at least 75% of the height of the drinking glass. The top cover comprises a small opening near the edge. The method then comprises installing the safety cover onto the drinking glass. In an embodiment, the safety cover is installed in such a way as to make it difficult to remove unobtrusively. In an embodiment, the safety cover is installed in such a way that it cannot be removed without lifting up the drinking glass. In an embodiment, the method further comprises inserting a straw through the small opening, wherein the small opening is such that when a straw is inserted into the small opening, a pill cannot be inserted into it without removing the straw.

LIST OF FIGURES

DETAILED DESCRIPTION

Figure 1:
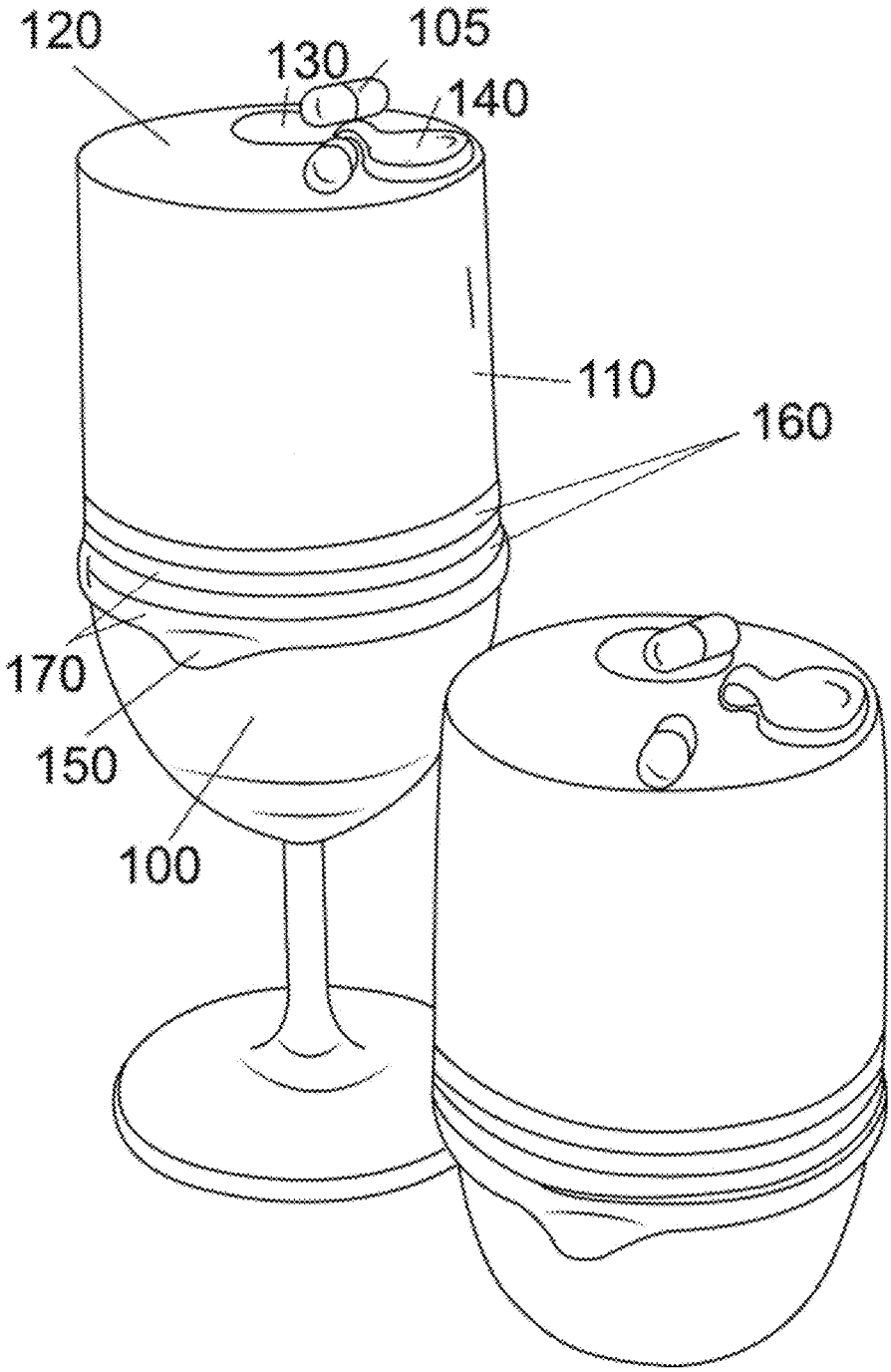
FIG. 1 shows an embodiment of the safety cover of the present invention.

FIG. 1 shows two glasses 100 protected by embodiments of the present invention. As can be seen, this embodiment of the present invention comprises a cylindrical body 110 with an opening at the bottom. The cylindrical body comprises a top cover 120 that is an integral part of the body. An opening 130 is placed in the top cover close to an edge; it is protected by a removable sip plug 140. The safety cover also comprises at least two tabs 150 to make it easier to put it on the glass. The pill 105 is shown for illustration purposes.

The safety cover preferably covers most of the glass, as shown in the Figure, to make it more difficult to remove or lift up without someone noticing. In an embodiment of the invention, it is made so as to cover approximately 75% of the vertical height of a typical glass. In an embodiment of the invention, the vertical height of the invention is approximately 2.5 inches, though it could be a little more or less than that dimension, depending on the desired size of glass that needs to be protected. The safety cover also is intended to fit very tightly over the glass in order to make it even harder to remove.

In an embodiment, the safety cover comprises a high-friction material such as silicone rubber to improve adhesion to the glass and make it harder to remove, especially if the cover is stretched over the glass. The safety cover could also comprise a special adhesion feature to improve adhesion still more, as shown in FIG. 1. This feature comprises two recessed rings 160 as shown, and two cylindrical rings 170 that are the same thickness or greater thickness than the main body of the cylindrical body. This provides a slight suction and better adhesion to the glass, making it even harder to remove. In the Figure, the recessed rings and the cylindrical rings are 5 mm in height each; however, any other heights are acceptable as long as a requisite level of suction is maintained. The material thickness of the recessed rings is 0.5 mm; the thickness of the upper cylindrical ring is 0.8 mm (same as the thickness of the cylindrical body), and the thickness of the lower cylindrical ring is 1 mm to provide better edge strength. In an embodiment, the silicone rubber is as smooth as possible on the inside to provide better adhesion to the glass.

This is a major advantage of the present invention. While other lids do exist for preventing spills and assisting children or vehicle passengers to drink their beverages without spillage, typically such lids are designed to be easy to install and remove. It would only add stress to a parent's day to have to struggle with the lid to a child's sippy cup, or to a commuter's day if they had to expend significant effort to install the lid on their travel mug. However, in a situation where one wishes to prevent unauthorized tampering with one's drink, a typical sippy cup lid or travel mug lid is going to be too easy for someone to lift up without the owner noticing, and the goal should be to make the lid as difficult as possible to remove. If it takes a significant amount of effort to remove the cover, it is more likely that someone will notice the attempted drink tampering and alert the owner.

The diameter of the safety cover may vary in order to fit different sizes of glass; however, since the safety cover can stretch, any given safety cover can fit a range of glass sizes. In an embodiment of the invention, the diameter of the safety cover is 2.5 inches, and it is flexible enough to fit cups or glasses with a diameter range of 2.5-4.33 inches.

The safety cover is preferably made of an elastic material such as silicone rubber, which has enough stretch to fit over different sizes of drink glasses while also being tight enough that it would be difficult to remove. In an embodiment of the invention, the material is food-safe silicone rubber, so that it can come into contact with the drink without issues; other materials may also be used as long as they are elastic and food-safe. In an embodiment of the invention, the thickness of the silicone is approximately 0.8 mm on the cylindrical body and 1 mm on the top cover.

In an embodiment, the safety cover is translucent, to make it less obtrusive and obvious in a bar or other public drinking situation where a user may not want to look unfashionable or uncool.

The opening 130 is preferably large enough to enable the insertion of a straw, and may be shaped like an elongated rectangle with two semicircles at each end, as shown in the Figure. The opening should also be small and narrow enough to prevent the insertion of a pill or powder into the drink through it. In the preferred embodiment, the width of the opening is approximately 5 mm to enable the insertion of a 5 mm straw. The length of the opening may be slightly longer, such as 1 cm, to allow for comfortable sipping if a user decides to drink directly through the opening, or for air to enter the glass if the user uses a straw. However, the opening should be small enough that a pill cannot be easily inserted into the opening when a straw is in place.

Figure 2:
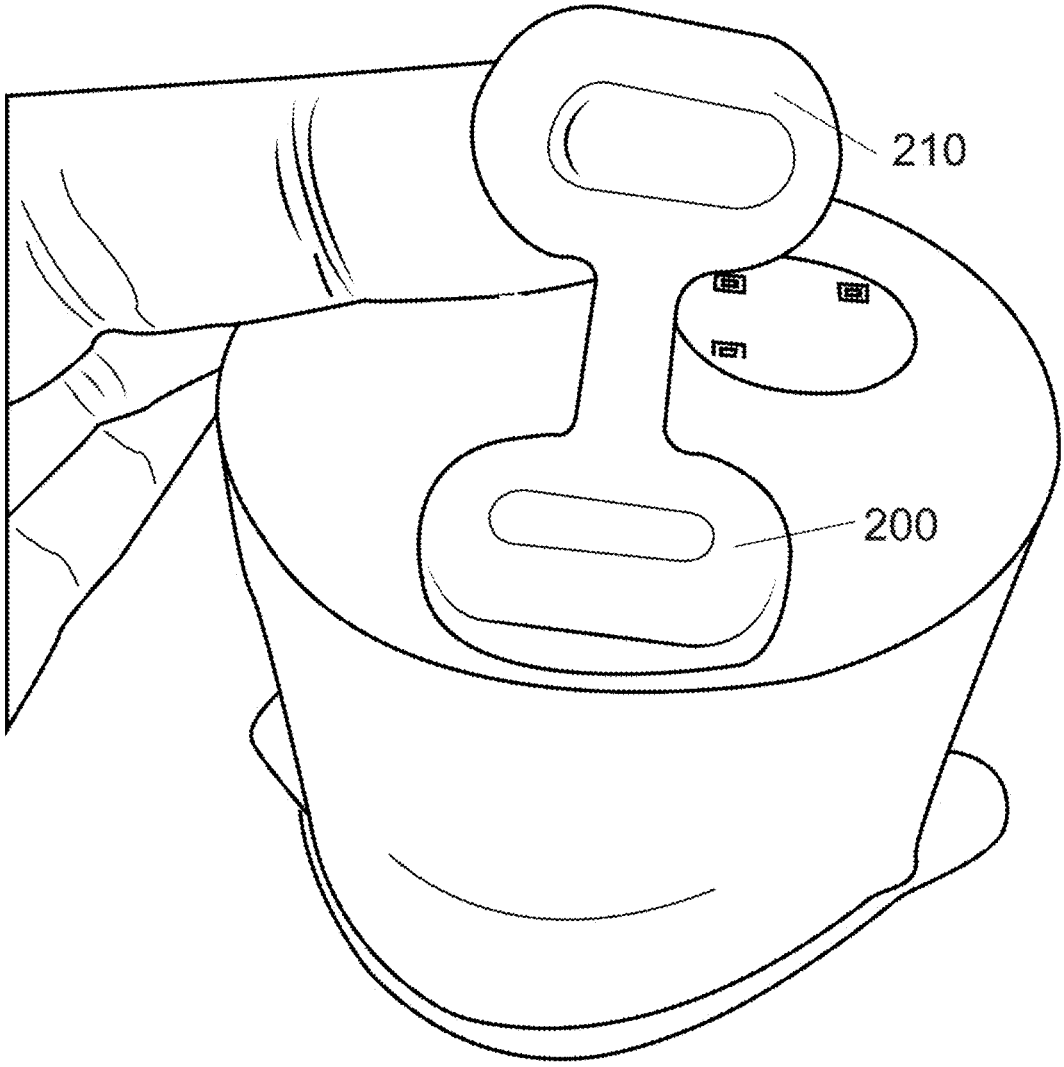
FIG. 2 shows another view of the safety cover of the present invention.
Figure 3:
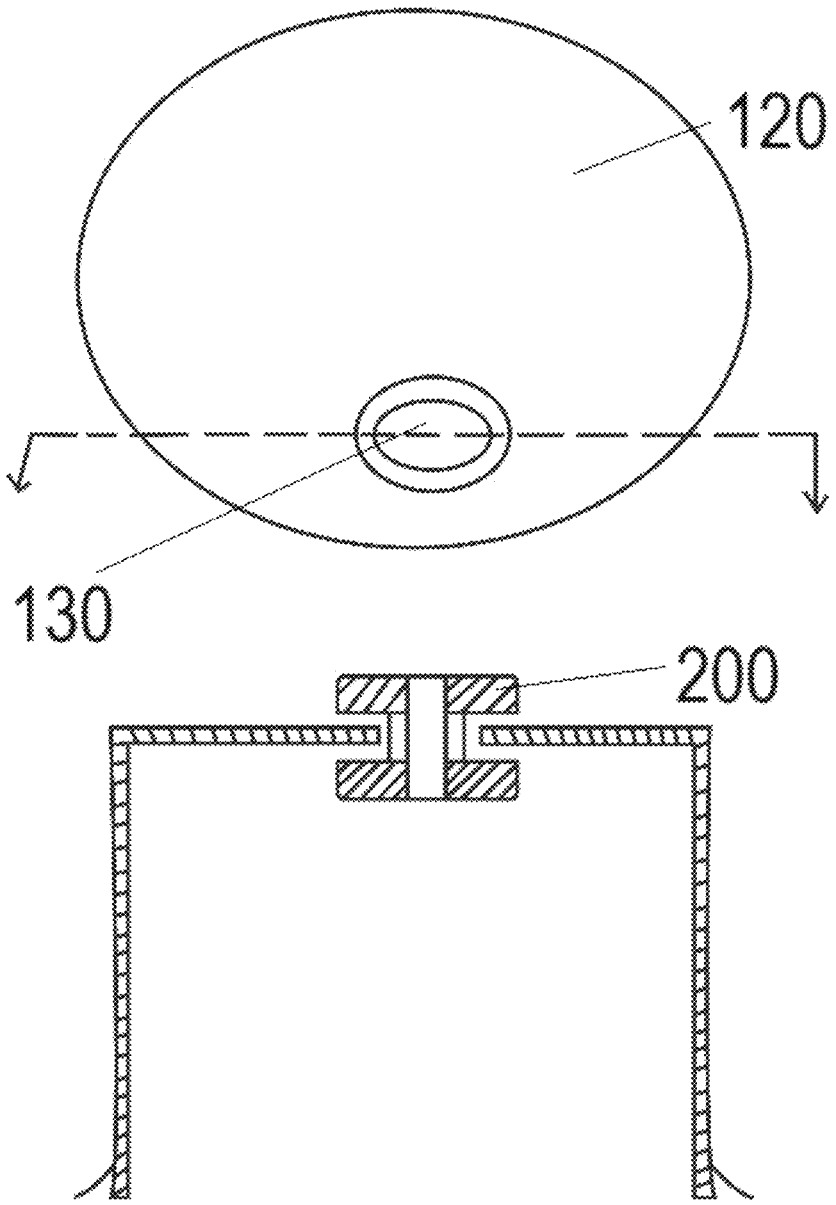
FIG. 3 shows a cross sectional view of the present invention.

In an embodiment, the opening 130 comprises a lip around the opening that can interlock with a removable sip plug 140, as shown. The sip plug comprises a ring 200 that interlocks with the opening and an attached plug 210 that plugs into the opening, as shown in FIG. 2. This covers the drink completely, which is helpful for travel or other occasions when it is desirable to avoid spillage, and where it's desirable to be able to open and close the opening. However, since the plug may get in the way in a drinking situation, it is advantageous to have it be removable. FIG. 3 shows a cross-sectional view of the opening 130 with the sip plug ring 200 in place (the plug 210 is not shown). As shown, the sip plug ring locks into the opening and protrudes on either side of the opening. This prevents leaks and ensures it is held securely.

In an embodiment, the safety cover comprises tabs 150 to pull it onto the drink. While the Figures show two tabs, other numbers of tabs are possible, to make it easier to pull the safety cover onto the glass. For example, the safety cover could comprise three or four tabs, evenly spaced around the circumference. Given that the safety cover of the present invention is intended to be as difficult as possible to install and to remove, the tabs should be strong enough to withstand the requisite amount of force.

While the primary purpose of this invention is to protect a drink from unauthorized tampering, it is also useful for preventing spillage during car trips or travel, for helping young children drink without making a mess, and for keeping insects out of one's drink at outdoor drinking occasions.

Another advantage of the present invention is that when the safety cover is placed on a glass and the sip opening is closed, the drink can float in water without being contaminated by the water. This would mean that a person can enjoy a drink in a pool or at the beach without worrying about dropping the drink by accident; if the drinking glass falls in the water, it will float and the water will not enter the drink. A typical prior art lid is not as securely attached to the drink and is more likely to fall off if the drink is dropped.

Exemplary embodiments are described above. It will be understood that the present invention encompasses other reasonable equivalents to the elements described above, as is evident to a person of reasonable skill in the art.

The invention claimed is:

1. A safety cover for a beverage, comprising:

an approximately flat circular top cover, comprising a small sip opening close to an edge, comprising a thin elastic material, wherein the radius of the top cover is smaller than the radius of a drinking glass;

a cylindrical body projecting from the circular top cover, wherein the cylindrical body is configured so as to fit tightly around a drinking glass and to cover at least 75% of the height of a drinking glass;

at least two pull tabs placed on a distal edge of the cylindrical body in such a way as to assist in its installation or removal;

wherein the cylindrical body comprises an inner surface, wherein the inner surface comprises at least one high-friction surface;

wherein the at least one high-friction surface comprises a cylindrical ring, further comprising a recessed ring above the cylindrical ring, a second recessed ring below the cylindrical ring, and a lower cylindrical ring below the second recessed ring, with the lower cylindrical ring located at an edge of the cylindrical body.

2. The safety cover of claim 1, wherein the top cover and the cylindrical body are made of silicone rubber.

3. The safety cover of claim 1, wherein the top cover has a thickness of approximately 1 mm and the cylindrical body has a thickness of approximately 0.8 mm.

4. The safety cover of claim 1, wherein the top cover and the cylindrical body are translucent.

5. The safety cover of claim 1, wherein the top cover has a diameter of 2.5 inches.

6. The safety cover of claim 1, wherein the cylindrical body has a height of at least 2.5 inches.

7. The safety cover of claim 1, wherein the cylindrical body has a diameter that is less than a diameter of a drinking glass on which it is installed.

8. The safety cover of claim 1, wherein the cylindrical ring and the lower cylindrical ring have a height of approximately 5 mm.

9. The safety cover of claim 1, wherein a thickness of the recessed ring and the second recessed ring is approximately 0.5 mm, wherein a thickness of the cylindrical ring is 0.8 mm, and wherein a thickness of the lower cylindrical ring is 1 mm.

10. The safety cover of claim 1, wherein the sip opening has a diameter of no more than 5 mm.

11. A safety cover for a beverage, comprising:

an approximately flat circular top cover, comprising a small sip opening close to an edge, comprising a thin elastic material, wherein the radius of the top cover is smaller than the radius of a drinking glass;

a cylindrical body projecting from the circular top cover, wherein the cylindrical body is configured so as to fit tightly around a drinking glass and to cover at least 75% of the height of a drinking glass;

at least two pull tabs placed on a distal edge of the cylindrical body in such a way as to assist in its installation or removal;

wherein the sip opening has a width of approximately 5 mm and a length of approximately 1 cm.

12. The safety cover of claim 11, wherein the sip opening comprises a lip around its perimeter, further comprising:

a sip plug that can close off the opening, wherein the sip plug comprises:

a ring that interlocks with the opening;

a plug attached to the ring that plugs into the opening and occludes it completely.

13. The safety cover of claim 11, wherein the top cover and the cylindrical body are made of silicone rubber.

14. The safety cover of claim 11, wherein the top cover has a thickness of approximately 1 mm and the cylindrical body has a thickness of approximately 0.8 mm.

15. The safety cover of claim 11, wherein the top cover and the cylindrical body are translucent.

16. The safety cover of claim 11, wherein the top cover has a diameter of 2.5 inches.

17. The safety cover of claim 11, wherein the cylindrical body has a height of at least 2.5 inches.

18. The safety cover of claim 11, wherein the cylindrical body has a diameter that is less than a diameter of a drinking glass on which it is installed.

* * * * *